US010640944B2

(12) United States Patent
Thomas et al.

(10) Patent No.: US 10,640,944 B2
(45) Date of Patent: May 5, 2020

(54) PIER TOOL AND METHOD OF USE

(71) Applicant: PPI ENGINEERING & CONSTRUCTION SERVICES, LLC, Houston, TX (US)

(72) Inventors: Ronald D. Thomas, Kingwood, TX (US); Tommy L. Williamson, New Braunfels, TX (US)

(73) Assignee: PPI ENGINEERING & CONSTRUCTION SERVICES, LLC, Houston, TX (US)

( * ) Notice: Subject to any disclaimer, the term of this patent is extended or adjusted under 35 U.S.C. 154(b) by 0 days.

(21) Appl. No.: 16/047,480

(22) Filed: Jul. 27, 2018

(65) Prior Publication Data

US 2019/0032296 A1 Jan. 31, 2019

Related U.S. Application Data

(60) Provisional application No. 62/538,047, filed on Jul. 28, 2017.

(51) Int. Cl.

| | |
|---|---|
| ***E02D 3/08*** | (2006.01) |
| ***E02D 5/36*** | (2006.01) |
| ***E02D 7/18*** | (2006.01) |
| ***E02D 7/06*** | (2006.01) |
| ***E02D 5/44*** | (2006.01) |

(52) U.S. Cl.

CPC ..... *E02D 3/08* (2013.01); *E02D 5/36* (2013.01); *E02D 5/44* (2013.01); *E02D 7/06* (2013.01); *E02D 7/18* (2013.01)

(58) Field of Classification Search

CPC ..... E02D 3/08

See application file for complete search history.

(56) References Cited

FOREIGN PATENT DOCUMENTS

| | | | | |
|---|---|---|---|---|
| GB | 2311083 A * | 9/1997 | ..... | E02D 3/02 |
| GB | 2372517 A * | 8/2002 | ..... | E02D 3/08 |
| WO | WO-2018011435 A2 * | 1/2018 | ..... | E02D 3/054 |

* cited by examiner

*Primary Examiner* — Janine M Kreck

(74) *Attorney, Agent, or Firm* — Nolte Intellectual Property Law Group

(57) ABSTRACT

A pier tool, includes: a tubular body having an uphole end and a downhole end and defining a flow path therethrough and a tamping head disposed within the flow path of the tubular body and defines tamping surface on a downhole side of the tamping head A method for forming a pier includes assembling a pier tool mandrel, a pier tool mandrel including the pier tool and forming a rammed aggregate pier using the pier tool mandrel.

24 Claims, 5 Drawing Sheets

PIER TOOL AND METHOD OF USE

CROSS-REFERENCE TO RELATED APPLICATIONS

This application claims the benefit of U.S. Provisional Patent Application having Ser. No. 62/538,047 which was filed Jul. 28, 2017. The aforementioned patent application is hereby incorporated by reference in its entirety into the present application to the extent consistent with the present application.

STATEMENT REGARDING FEDERALLY SPONSORED RESEARCH OR DEVELOPMENT

Not applicable.

BACKGROUND

This section introduces information from the art that may be related to or provide context for some aspects of the technique described herein and/or claimed below. This information is background facilitating a better understanding of that which is disclosed herein. The presentation of this information is therefore a discussion of "related" art. That such art is related in no way implies that it is also "prior" art. The related art may or may not be prior art. The discussion is to be read in this light, and not as admissions of prior art.

One common construction feature is a ground improvement called a "pier", or a "construction pier". A pier is typically a structure that is driven into the ground using a percussive or vibratory hammer. One particular kind of pier is what is known as a "rammed aggregate pier". Instead of driving a pier structure into the ground, a pier structure is created in a bore by pouring in some aggregate, tamping it down, and repeating the process until the structure reaches the ground surface.

There are several approaches including both tools and techniques for the construction of piers. Many or all of these approaches may be competent for their intended purposes. The art, however, is always receptive to improvements or alternative means, methods and configurations. Therefore, the art will well receive the approach described herein.

SUMMARY

In a first aspect, a pier tool comprises a tubular body and a tamping head. The tubular body has an uphole end and a downhole end and defines a flow path therethrough. The tamping head is disposed within the flow path of the tubular body and defines a tamping surface on a downhole side thereof and an off-center aperture therethrough.

In a second aspect, a pier tool mandrel for use in forming a rammed aggregate pier comprises at least a pair of pipe pieces, a pier tool disposed between the pair of pipe pieces, and a driving shoe disposed on the downhole end of the most downhole pipe piece. The pier tool further comprises a tubular body and a tamping head. The tubular body has an uphole and a downhole end and defines a flow path therethrough. The tamping head is disposed within the flow path of the tubular body and defines a tamping surface on a downhole side thereof and an off-center aperture therethrough.

In a third aspect, a method for forming a pier, comprises: assembling a pier tool mandrel, forming a bore in the earth; depositing aggregate into the bore through the pier tool mandrel; ramming the aggregate, the driving force of the ramming being delivered by the pier tool; lifting the pier tool mandrel a predetermined distance; and repeating depositing, ramming, and lifting until the surface is reached. The pier tool mandrel comprises at least a pair of pipe pieces, a pier tool disposed between the pair of pipe pieces, and a driving shoe disposed on the downhole end of the most downhole pipe piece. The pier tool further comprises a tubular body and a tamping head. The tubular body has an uphole and a downhole end and defines a flow path therethrough. The tamping head is disposed within the flow path of the tubular body and defines a tamping surface on a downhole side thereof and an off-center aperture therethrough.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which:

FIG. 2A-FIG. 2D illustrate more clearly the tamping head of the pier tool of FIG. 1, wherein FIG. 2A-FIG. 2D are perspective, plan top, plan bottom, and side, partially sectioned views, respectively, of the tamping head in isolation from the rest of the pier tool, except FIG. 2D shows the tamping head in the context of the tubular member.

FIG. 5A-FIG. 5C illustrate a pier tool mandrel in accordance with some aspects of the present invention employing the pier tool assembly of FIG. 4 in which FIG. 5A is a plan, partially sectioned side view of the mandrel and FIG. 5B-FIG. 5C are top and side plan views of the driving shoe, with FIG. 5C being partially sectioned.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
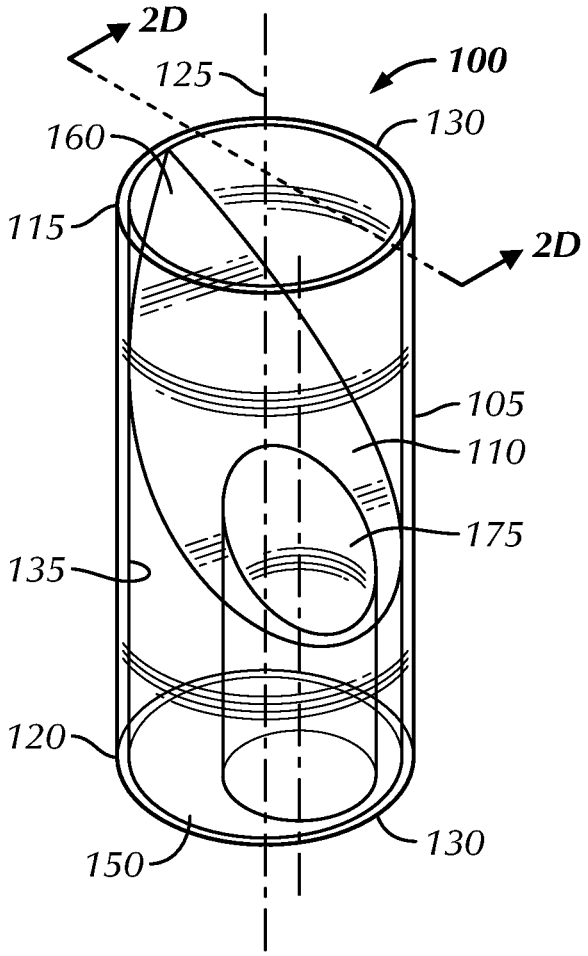
FIG. 1 is a perspective view of one particular embodiment of a pier tool in accordance with various aspects of the present invention.

Turning now to the drawings, FIG. 1 is a perspective view of one particular embodiment of a pier tool 100. The pier tool 100 comprises a tubular body 105 and a tamping head 110, the tamping head 110 defining a tamping surface as described below. The tubular body 105 is threaded at the uphole and downhole ends 115, 120 thereof and defines a flow path 125 therethrough. The threads 130 may be of any conventional design and may be consistent with other threads found on pipe elsewhere in the intended construction environment. The tamping head 110 disposed within the flow path 125 of the tubular body 105 and is affixed to the inner surface 135 of the tubular body 105. The affixation may be by any suitable technique known to the art, for example, by a threaded engagement or by welding.

Figure 2A:
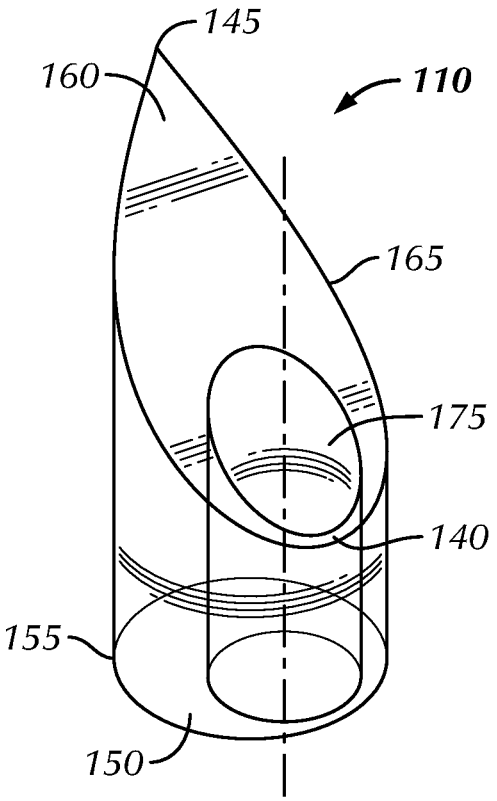
Figure 2B:
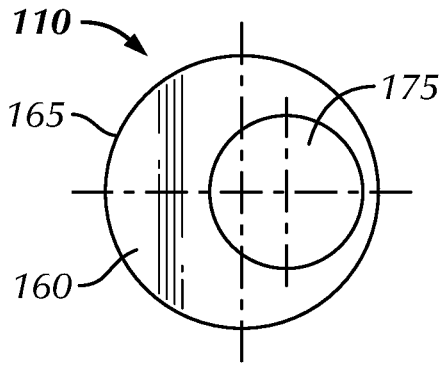
Figure 2C:
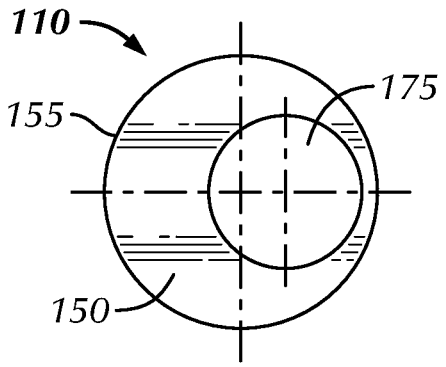
Figure 2D:
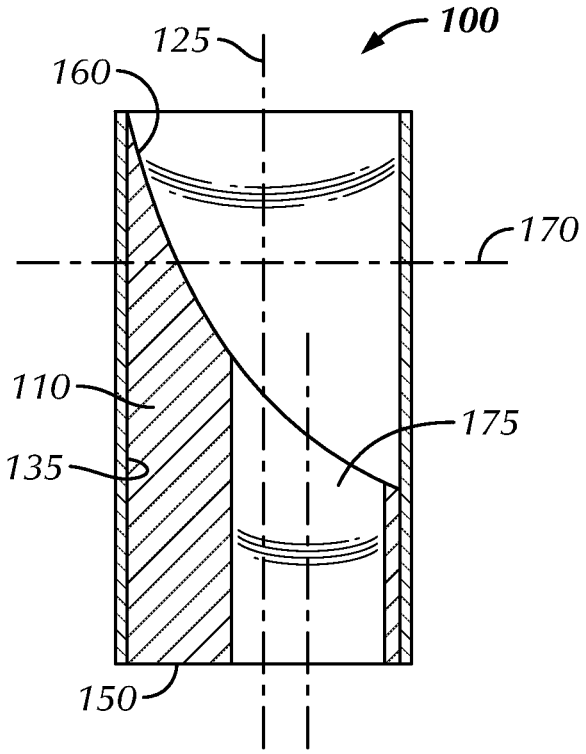

FIG. 2A-FIG. 2D illustrate more clearly the tamping head 110 of the pier tool 100 of FIG. 1 in isolation from the rest of the pier tool 100. FIG. 2A is a perspective view and FIG. 2A-FIG. 2C are plan top, plan bottom, and side views, respectively, of the tamping head 110. The tamping head 110 defines an uphole surface 160 on the uphole end 165 thereof that is shaped like a teardrop, having a wide end 140 and a narrow end 145. The tamping head 110 curves concavely, toward the downhole end 120, when viewed from the uphole end 115 as best shown in FIG. 2D. The narrow end 145 is positioned uphole of the wide end 140. The curvature and geometry of the uphole surface 160 are designed to direct falling aggregate into the aperture 175 as it is deposited in the bore (not yet shown) as described more fully below. The uphole area 160 therefore acts as a "slide area" for the aggregate as it is deposited. However, this is not necessary to the practice of the approach described herein in all embodiments.

More particularly, the uphole surface 160 is designed with an increasing radius of 95% of the outside diameter (10.25") at the top of the tool to 148.84% of the outside diameter of the tool (16") radius at the bottom of the uphole surface 160 to funnel rock, aggregate, and other similar materials used in the art into the flow path 125. The flow path 125 can vary in diameter from more than 50% of the pier tool 100 outer diameter to a maximum of 70.7% and achieve a tamping head of 100% of the external diameter of the pier tool when the pier tool assembly (shown in FIG. 3A-FIG. 3B) is assembled with the two flow paths 180° out of phase with each other.

Referring to FIG. 2D, the uphole surface 160 is oriented at an angle $\beta$ relative to both the longitudinal axis 175 defined by the flow path 135 and an angle $\alpha$ relative to the radial, axis 170. As shown best in FIG. 2A, the narrow end 145 is uphole of the wide end 140 and curved convexly relative to the downhole end 120 of the tubular body 105 as described above. The tamping head 110 also defines an off-center aperture 175 therethrough. The purpose of the aperture 175 is to permit aggregate (not shown) to pass through the tamping head 110 in a manner discussed more fully below.

Figure 3D:
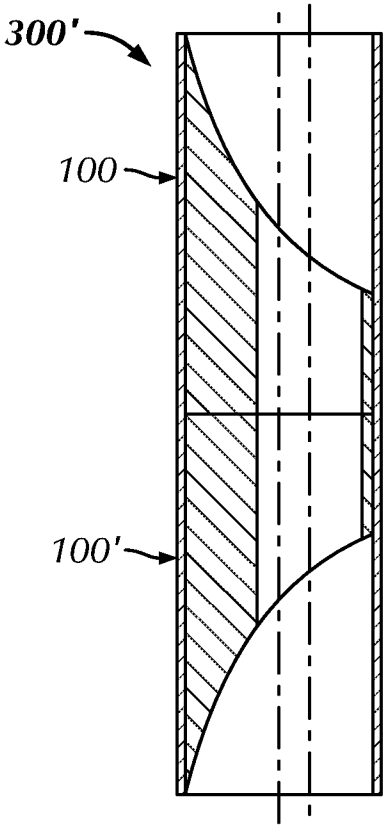
FIG. 3C-FIG. 3D depict a second pier tool assembly using the pier tool of FIG. 1 in a partially sectioned, perspective view and a partially sectioned, plan view.
Figure 3C:
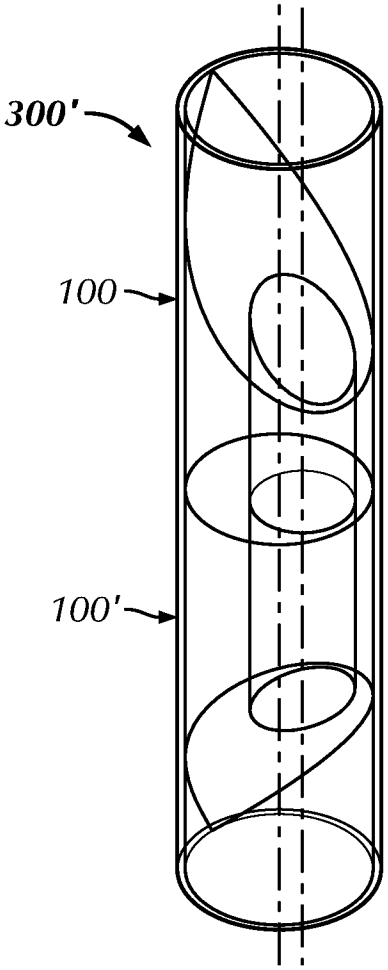
Figure 3B:
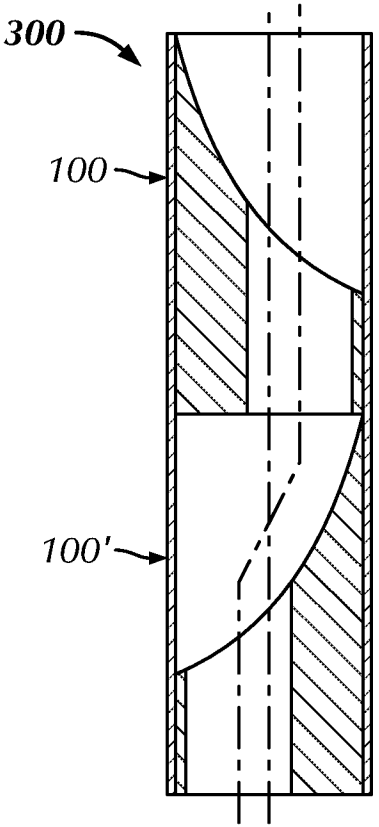
FIG. 3A-FIG. 3B depict a first pier tool assembly using the pier tool of FIG. 1 in a partially sectioned, perspective view and a partially sectioned, plan view.
Figure 3A:
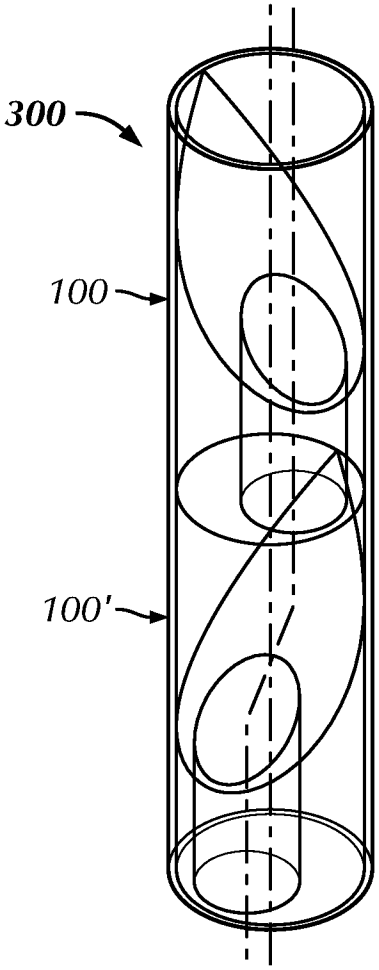

The pier tool 100 will typically, though by no means exclusively, be employed in pairs, such as is shown in FIG. 3A-FIG. 3B, as part of a pier tool assembly 300. The pier tools 100, 100' are shown assembled back to back. In this particular embodiment, this is by threaded engagement of the threads 130, shown in FIG. 1, on each of the pier tools 100, 100', but may be achieved in other ways in alternative embodiments. For example, some embodiments may choose to weld the pier tools 100, 100' together. In embodiments wherein the pier tools 100, 100' are welded, the threads 130 may be omitted.

In the embodiment of FIG. 3A-FIG. 3B, the pier tools 100, 100' are radially offset from one another so as to offset the apertures 175 from one another in the radial direction. This is generally desirable, but not necessary. In embodiments in which the apertures 175 are radially offset, the degree of offset may vary. The radial offset between the apertures 175 in FIG. 3A-FIG. 3B is 180°. The pier tools 100, 100' are still both oriented in the same direction in the uphole/downhole context of the bore (not shown).

However, alternative embodiments may deploy the pier tools 100, 100' differently. For example, consider the embodiment 300' in FIG. 3C-FIG. 3D. Here the orientation of the pier tool 100' has been inverted and the apertures 175 are radially aligned. Still other embodiments may become apparent to those skilled in the art having the benefit of this disclosure.

Returning to FIG. 3A-FIG. 3B, the tamping heads 110 are displaced axially from one another by the distances determined by the dimensions of the tubular bodies 105 of the pier tools 100, 100'. Because of the shape and orientation of the tamping heads 110, the distance therebetween will vary by location on the respective heads. For example, the narrow end 145 of the uphole tamping head 110 and the wide end 140 of the downhole tamping head 110 are axially displaced a greater distance than are the wide end 140 of the uphole tamping head 110 and the narrow end 145 of the downhole tamping head 110. This will be a function not only of the shapes of the surfaces 150, 160, but also the degree of radial offset between the two tamping heads 110.

Figure 4:
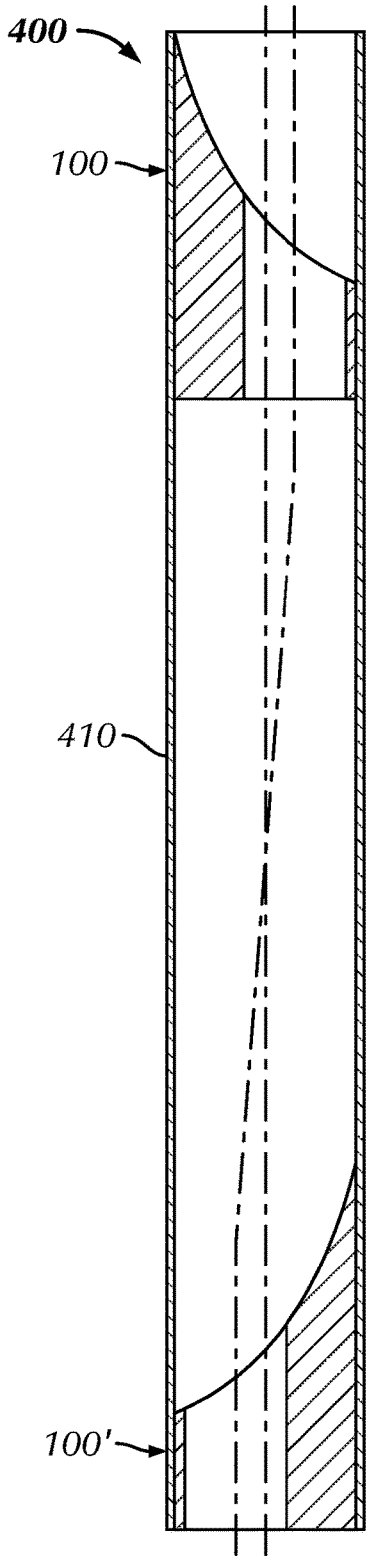
FIG. 4 is a partially sectioned, plan view of a second pier tool assembly including the pier tools of the embodiment in FIG. 3A-FIG. 3B.

The vertical displacement of the pier tools 100, 100' in FIG. 3 can be readily increased. FIG. 4 is a partially sectioned, plan view of a pier tool assembly 400 including the pier tools 100, 100' of FIG. 3. The pier tools 100, 100' are separated by a pipe section 410, the pier tools 100, 100' being threadably engaged to the pipe section 410 by their respective threads 130 (shown in FIG. 1) and mating threads (not shown) on the pipe section 410. Note that, in alternative embodiments, the pier tools 100, 100' may be engaged with to the pipe section 410 using some other mechanism. For example, some embodiments may weld the pier tools 100, 100' to the pipe section 410. As previously mentioned, in embodiments employing welding the threads 130, as well, as any threads (not shown) on the pier section 410, may be omitted. The pipe section 410 may be any length to provide the desired vertical displacement. Some embodiments may also employ more than one pipe section 410 for this reason, as well.

Some embodiments may extrapolate from the principles illustrated in FIG. 3A-FIG. 4 by employing more than two pier tools 100, 100'. They may be assembled together back-to-back-to-back, and so on, or they may be separated by one or more pipe sections 410. However, it is generally anticipated that the most commonly used embodiments will be similar to the pier tool assembly 400 in FIG. 4. That is, a pair of pier tools 100, 100' separated by a pipe section 410.

Figure 5A:
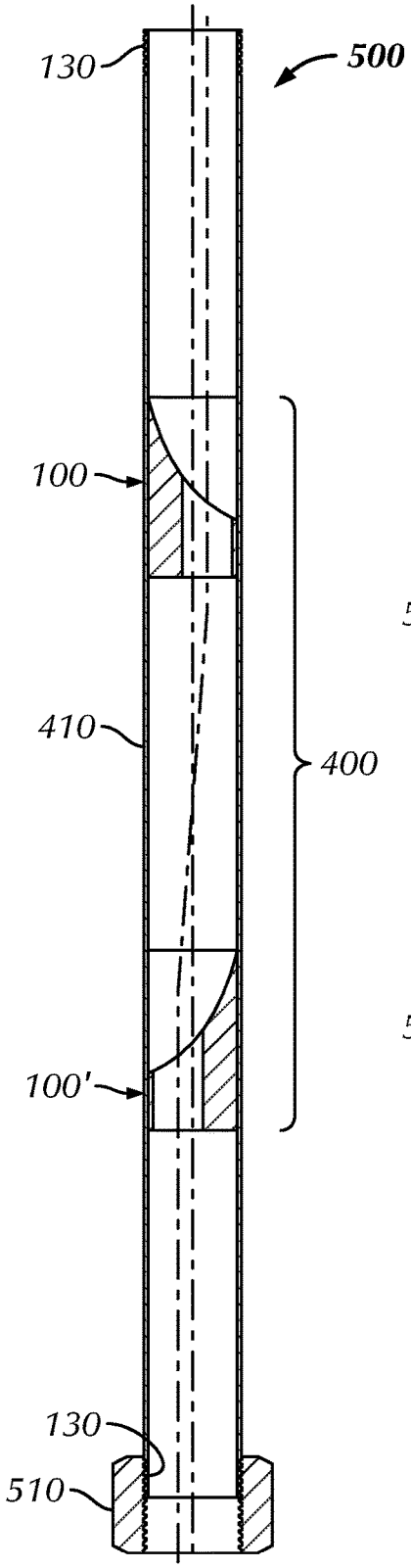
Figure 5B:
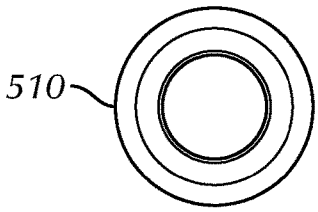
Figure 5C:
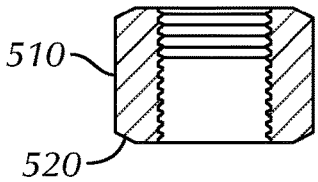

The pier tool 100, whether as a pier tool assembly 300, 300', 400 or singly, may be assembled into a pier tool mandrel like the pier tool mandrel 500 in FIG. 5A. The pier tool mandrel 500 includes not only the pier tool assembly 400 of FIG. 4, but also a driving shoe 510, shown also in FIG. 5B-FIG. 5C. The driving shoe 510 is axially displaced from the downhole pier tool 100' by a section of pipe 410. The pier tool assembly 400 is suspended from one or more additional pipe sections 410 when disposed in the bore 600. The driving shoe 510, has 30° shoulders 520, shown in FIG. 5C, to allow the drive shoe 510 to increase side load onto the displaced material and to reduce a build-up of, stresses in the drive shoe 510. The drive shoe 510 further protects the bottom of the pier tool assembly 400 and increases the downforce created by increasing the surface area of the pier tool assembly 400 by more than 280% (18" OD).

Figure 6:
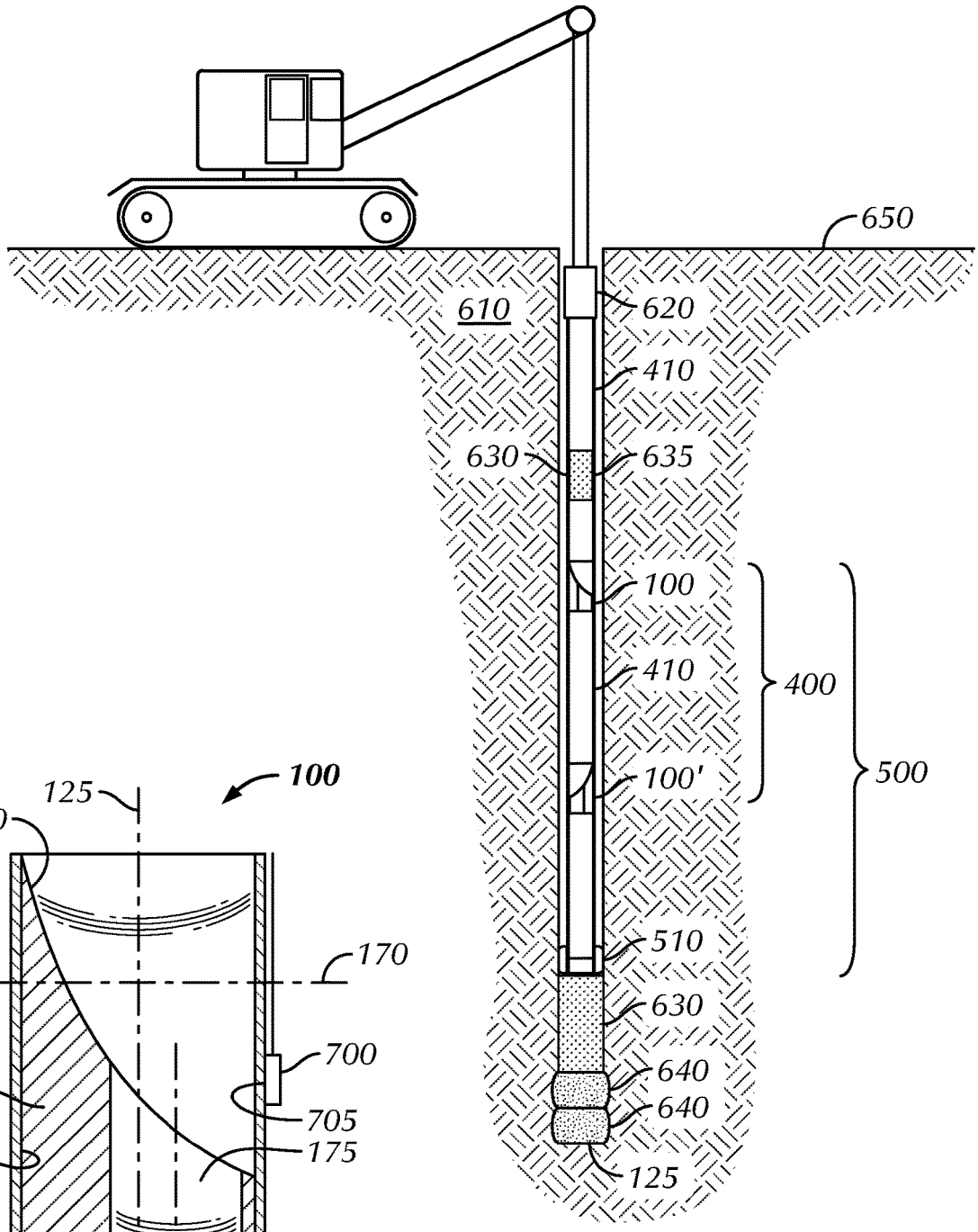
FIG. 6 illustrates the use of the pier tool mandrel of FIG. 5A-FIG. 5C in the construction of a pier in accordance with selected aspects of the present invention.

Referring now to FIG. 6, a method for forming a pier is presented. This particular method uses the pier tool mandrel 500 discussed above, which uses the pier tool assembly 400, also discussed above. This particular embodiment of the method presumes that the bore 600 has previously been constructed. The construction of bores such as the bore 600 is known to the art of rammed aggregate piers and any such construction technique known to be suitable to the art may be used.

The method begins, in this particular embodiment, with the assembly of the pier tool mandrel 500. As described above, each pier tool 100, 100' includes threads 130 at each end 115, 120 thereof. The pipe section 410 includes mating threads (not shown) by which the pipe section 410 is threadably engaged with the pier tools 100, 100'. The pier tool mandrel 500 may be assembled onsite or at some remote facility and shipped to the site. Additional pipe sections 410 may be employed should it be so desired.

In some embodiments, such as the one illustrated, the bore 600 is formed by driving the pier tool mandrel 500 into the earth 610 to a predetermined depth to form the bore 600. The pier tool mandrel 500 is driven using a hammer 620 of some sort as is known in the art for this purpose. The hammer 620 may be a percussive or a vibratory hammer, for example. This is convenient in that, the pier tool mandrel 500 is then properly positioned in the bore for the next steps. In alternative embodiments, the bore 600 may be formed using other techniques, such as by being augured. Any suitable technique known to the art may be used.

Once the bore 600 is formed, the method continues by depositing aggregate 630 into the bore 600 through the pier tool mandrel 500. The aggregate 630 is deposited to fill the pier tool mandrel 500, as may be inferred by the partially section portion 635 of the pier tool mandrel 500. The pipe sections 410 are tubular, and thus permit the aggregate 630 to flow freely therethrough. Upon encountering the pier tools 100, 100', the aggregate 630 passes through the apertures 175, shown in FIG. 1, therethrough. Aggregate 630 that does not fall directly into the aperture 175 but instead strikes some other portion of the tamping head 110 is funneled into the aperture 175 by the slope in the uphole surface 160.

The aggregate 630 is deposited until it reaches a predetermined depth within the bore 600. The aggregate 630 may be, for example, crushed concrete, crushed stone, cement treated aggregate, or some combination of these. Any suitable aggregate known to the art for constructing piers may be used. The predetermined depth of the aggregate 630 introduced may ordinarily be as deep as 45' (13.7 m) and as low as 6" (15 cm), but is generally about 12' (3.7 m) to 20' (6.1 m) in the illustrated embodiment. The predetermined diameter of the aggregate 630 introduced may ordinarily be as high as 36" (0.9 m) and as small as 18" (46 cm).

The aggregate 630 is then rammed, the force being generated by the hammer 620 and delivered by the pier tools, 100, 100'. More particularly, the force is transmitted through the pipe sections 410 and delivered via the tamping surface 150 of each tamping head 110. The shape and curvature of the tamping surface 150 enables the tamping surface 150 to deliver a proportionally larger force that can be found in conventional practice. Note that, in the illustrated embodiment, this force is doubled by the use of two pier tools 100, 100'. Still further, this force is increased by the radial offset between the two pier tools 100, 100' as force is delivered by the tamping head 110 of the pier tool 100 over that portion of the aggregate column omitted by the tamping head 110 of the pier tool 100' because of the presence of the aperture 175.

The number of times the aggregate 630 is rammed will depend upon a number of factors that will become apparent to those skilled in the art having the benefit of this disclosure. Exemplary factors include, for example, the degree of compaction desired to meet the structural requirements as well as the amount of force that can be delivered by the hammer 620 on each stroke. The number of times the aggregate 630 is rammed will therefore be implementation specific. In the illustrated embodiment, the aggregate 630 will be compacted by 6" (15 cm), from 18" (45 cm) to 12" (30 cm). This ramming of the aggregate 630 creates what is known in the art as a "lift" 640. Two previous lifts 640 are shown in FIG. 6, although the process is the same for the first lift 640 in the bore 600.

Once the aggregate 630 has been compacted as desired, the hammer 620 is lifted so that additional aggregate 630 can be deposited on top the previous lift 640 as shown in FIG. 6. The amount of lift will also be implementation specific depending on a number of factors such as the desired depth of the resultant lift 640 and the amount of force that can be delivered from the hammer 620. Depending on the embodiment, the lift may be anywhere from 3' (0.9 m) to 5' (1.5 m), and will typically be 5° (1.5 m) in loose, unconsolidated soils. Note how the amount of lift affects the amount of aggregate 630 that is deposited since there should be enough aggregate 630 to permit the tamping head 110 to properly perform. The process of deposition, compaction, and lifting as described above continues until the surface 650 is reached.

The pier tool assembly 400 yields a 100% surface area to tamp the aggregate—which may be rock, crushed concrete, or similar material used in constructing piers. This is because of the 180° radial offset between the pier tool 100 and the pier tool 100'. No currently used tool known to the art allows for fill of the aggregate through the inner tool mandrel and while still providing 100% solid metal surface area for down force when tamping the aggregate. This increase in surface area should increase the bearing load of the piers up to the limits of what the surrounding in situ soils will allow.

In the description above, the bore 600 is described as having a diameter, which is a function of a circular cross-section for the bore 600. The bore 600 of the illustrated embodiment indeed has a circular cross-section. This is a function of the bore 600 being constructed using the driving shoe 510 and its geometry. However, such a circular cross-section is not required for the practice of the invention.

Should other techniques be used for constructing the bore 600, other geometries may be employed for the cross-section the bore 600.

Figure 7:
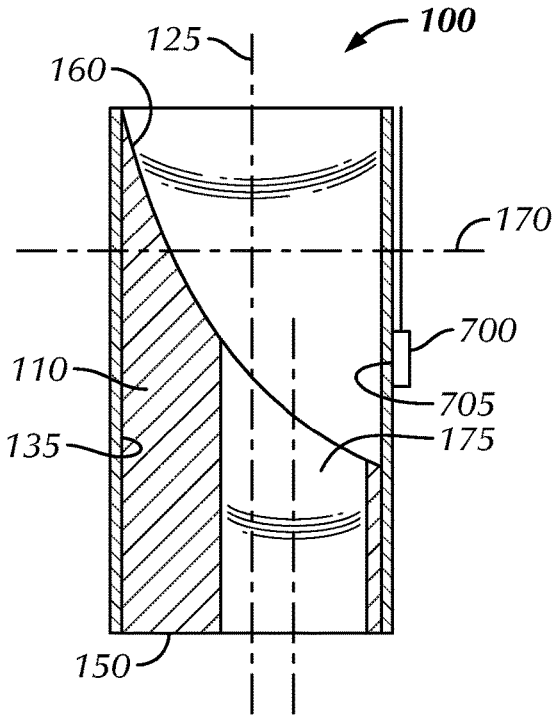
FIG. 7 illustrates an alternative embodiment in which air is injected to help the aggregate slide to the flow path if the aggregate is bridging off.

Those in the art having the benefit of this disclosure will appreciate still further alternative embodiments. For example, as shown in FIG. 7, air from the surface can be provided through a line 700 and injected through an air injection port 705 affixed to the outside of the pier tool 100. The air can be used to help the rock or aggregate slide to the flow path if the aggregate is bridging off. The air is under pressure, and can also be more generally used to facilitate the flow of the aggregate inside the mandrel. Ports may be fabricated into the side of the mandrel just above the pier tool(s) in a manner not shown. The air is piped down the outside of the mandrel through, for example, ¾" (2 cm)) diameter metal pipe. The air tube may be connected, also for example, to an air compressor (not shown) (185 cfm, or 5.2 mfm) with ¾" (2 cm) diameter hoses.

The terms "downhole" and "uphole" as used herein are used relative to the orientation of the pier tool and the pier tool mandrel in their intended and accustomed usage. It is well known in the art that the term "uphole" means the direction toward the surface through the path defined by the bore. Similarly, "downhole" means the direction toward the bottom of the bore through the path defined by the bore. Accordingly, "uphole" denotes those portions of the pier tool and the pier tool mandrel that, when in use, are proximal to the surface. Conversely, "downhole" denotes those portions of the pier tool and pier tool mandrel that, when in use, are proximal to the bottom of the bore.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A pier tool, comprising:

a tubular body having a threaded uphole end and a threaded downhole end and defining a flow path therethrough; and a tamping head disposed within the flow path of the tubular body and defining a tamping surface on a downhole side thereof and an off-center aperture therethrough.

2. The pier tool of claim 1, wherein the tamping head furthermore defines a teardrop-shaped uphole surface on an uphole side of the tamping head, the uphole surface having a narrow end and a wide end, the uphole surface being:

orientated at an angle relative to the radial axis of the tubular body, the narrow end being uphole of the wide end; and curved convexly relative to the downhole end of the tubular body.

3. The pier tool of claim 2, wherein the tubular body defines a port uphole of uphole surface.

4. The pier tool of claim 2, wherein the tamping surface is flat.

5. The pier tool of claim 1, wherein the tamping surface is flat.

6. The pier tool of claim 1, wherein the tamping head is affixed to the tubular body by welding.

7. The pier tool of claim 1, wherein the tubular body defines a port uphole of an uphole surface of the tamping head on the uphole side thereof.

8. A pier tool mandrel for forming a rammed aggregate pier, comprising:

a tubular body having an uphole and a downhole end and defining a flow path therethrough; and a tamping head disposed within the flow path of the tubular body and defining a tamping surface on a downhole side thereof and an off-center aperture therethrough; and a driving shoe disposed on the downhole end of the most downhole pipe piece.

9. The pier tool mandrel of claim 8, wherein the tamping head furthermore defines a teardrop-shaped uphole surface on an uphole side of the tamping head, the uphole surface having a narrow end and a wide end, the uphole surface being:

orientated at an angle relative to radial axis of the tubular body, the narrow end being uphole of the wide end; and curved convexly relative to the downhole end of the tubular body.

10. The pier tool mandrel of claim 9, wherein the tubular body defines a port uphole of uphole surface.

11. The pier tool mandrel of claim 9, wherein the tamping surface is flat.

12. The pier tool mandrel of claim 8, wherein the tamping surface is flat.

13. The pier tool mandrel of claim 8, wherein the uphole and downhole ends are threaded.

14. The pier tool mandrel of claim 8, wherein the tubular body defines a port uphole of an uphole surface of the tamping head on the uphold side thereof.

15. The pier tool mandrel of claim 8, further comprising a second pier tool disposed between two pieces of pipe and at least one pipe piece apart from the first pier tool.

16. The pier tool mandrel of claim 15, wherein the radial orientation of the second pier tool is offset from that of the first pier tool.

17. The pier tool mandrel of claim 16, wherein the radial orientation offset is 180°.

18. A method for forming a pier, comprising:

assembling a pier tool mandrel, the pier tool mandrel comprising:

at least a pair of pipe pieces;

a pier tool disposed between the pair of pipe pieces, the pier tool further comprising:

a tubular body threaded at the uphole and downhole ends thereof and defining a flow path therethrough; and a tamping head disposed within the flow path of the tubular body and defining a tamping surface on a downhole side thereof and an off-center aperture therethrough; and a driving shoe disposed on the downhole end of the most downhole pipe piece;

forming a bore in the earth;

depositing aggregate into the bore through the pier tool mandrel;

ramming the aggregate, the driving force of the ramming being delivered by the pier tool;

lifting the pier tool mandrel a predetermined distance; and repeating depositing, ramming, and lifting until the surface is reached.

19. The method of claim 18, wherein assembling the pier tool mandrel includes welding the pipe pieces to the tamping head.

20. The method of claim 18, wherein assembling the pier tool mandrel includes threadably engaging the pipe sections and the tamping head.

21. The method of claim 18, wherein assembling the pier tool mandrel includes assembling the pier tool mandrel on site.

22. The method of claim 18, further comprising injecting air into the pier tool mandrel to facilitate the flow of the aggregate within the mandrel.

23. The method of claim 18, wherein injecting air into the pier tool mandrel includes injecting air into the pier tool mandrel at the pier tool to facilitate the flow of aggregate across an uphole surface of the tamping head.

24. The method of claim 18, wherein forming the bore includes driving the pier tool mandrel into the earth to a predetermined depth to form the bore.

* * * * *